US010012379B2

(12) United States Patent
Xie

(10) Patent No.: US 10,012,379 B2
(45) Date of Patent: Jul. 3, 2018

(54) SUNSHADE LAMP FIXING DEVICE AND SUNSHADE

(71) Applicant: Yotrio Group Co., Ltd., Linhai (CN)

(72) Inventor: Jianqiang Xie, Linhai (CN)

(73) Assignee: Yotrio Group Co., Ltd., Linhai, Zhejiang (CN)

( * ) Notice: Subject to any disclaimer, the term of this patent is extended or adjusted under 35 U.S.C. 154(b) by 258 days.

(21) Appl. No.: 14/970,170

(22) Filed: Dec. 15, 2015

(65) Prior Publication Data

US 2017/0167719 A1 Jun. 15, 2017

(51) Int. Cl.

| | |
|---|---|
| ***F21V 33/00*** | (2006.01) |
| ***E04H 15/58*** | (2006.01) |
| ***A45B 23/00*** | (2006.01) |
| ***F21S 8/08*** | (2006.01) |
| ***F21V 17/16*** | (2006.01) |

(52) U.S. Cl.

CPC ..... *F21V 33/006* (2013.01); *A45B 23/00* (2013.01); *E04H 15/58* (2013.01); *F21S 8/08* (2013.01); *F21V 17/164* (2013.01); *A45B 2023/0031* (2013.01); *A45B 2023/0037* (2013.01); *A45B 2023/0043* (2013.01); *A45B 2023/0062* (2013.01); *A45B 2200/1018* (2013.01)

(58) Field of Classification Search

CPC ..... F21V 33/006; F21V 17/164; F21S 8/063; F21S 8/083

See application file for complete search history.

(56) References Cited

U.S. PATENT DOCUMENTS

| | | | | |
|---|---|---|---|---|
| 2005/0117326 | A1* | 6/2005 | Ma | A45B 3/04 362/102 |
| 2008/0006312 | A1* | 1/2008 | Li | A45B 3/04 135/16 |
| 2009/0007945 | A1* | 1/2009 | Ma | A45B 3/02 135/16 |
| 2011/0089861 | A1* | 4/2011 | Zeng | F21V 17/14 315/294 |

* cited by examiner

*Primary Examiner* — Andrew Coughlin

(74) *Attorney, Agent, or Firm* — Jingming Cai; SAC Attorneys LLP

(57) ABSTRACT

Embodiments of the present invention provide a sunshade lamp fixing device, comprising: a lower sunshade disc, a sunshade disc plug and a lamp fastener; wherein the lower sunshade disc is disposed below a sunshade canopy of the sunshade; the sunshade disc plug is fixed at a lower end of the lower sunshade disc; the lamp fastener is detachably mounted at a lower end of the sunshade disc plug, and the sunshade lamp is detachably fixed on the lamp fastener. The sunshade lamp fixing device according to the embodiments of the present invention is simple in structure, detachable and convenient in operation and use. Embodiments of the present invention further provide a sunshade having a sunshade lamp fixing device.

8 Claims, 5 Drawing Sheets

SUNSHADE LAMP FIXING DEVICE AND SUNSHADE

FIELD OF THE INVENTION

The present invention relates to a technical field of mechanical design, and specifically to a sunshade lamp fixing device and a sunshade.

BACKGROUND OF THE INVENTION

A sunshade is extensively applied to sites such as beach, a villa, a swimming pool or a café. To meet a lighting requirement beneath a sunshade canopy of the sunshade, a current sunshade integrates a sunshade lamp. However, sunshade lamps of some current sunshades are directly fixedly mounted on a sunshade rib and are not detachable, so a consumer has to bear the cost caused by a damage to the sunshade lamp. Sunshade lamps of some current sunshades are mounted on an intermediate rod located between and configured to connect an upper sunshade disc and a lower sunshade disc, so that a there are shading objects (e.g., sunshade ribs and support bars of a sunshade structure) in front of a light-emitting area of the sunshade, thereby affecting the lighting effect of the lamp light.

The Chinese patent with an announcement and grant number CN201323954Y discloses a sunshade lamp fixing device as shown in FIG. 1 and FIG. 2, wherein a sunshade lamp 24 is detachably mounted on a lamp fastener 22, and the lamp fastener 22 is mounted at a lower end of a lower sunshade disc 21 and longitudinally slideable relative to the lower sunshade disc 21. A lower plug 23 is connected to a bottom end of the lamp fastener 22, and the lower plug 23 is provided with threads engaging with the lower sunshade disc 21. Since the sunshade lamp is disposed below the lower sunshade disc, it may refrain from shading of shading objects. However, when the sunshade lamp 24 needn't be used, for pleasant appearance purpose, the lamp fastener 22 needs to be slided upward to be received in the lower sunshade disc 21 and is fixed by the lower plug 23 and the lower sunshade disc 21 through threaded engagement so that the lamp fastener 22 is directly mounted in the lower sunshade disc 21 and not exposed out of the lower sunshade disc 21. As can be seen from the above, the sunshade lamp fixing device is relatively complicated in operation and use. In addition, the lamp fastener 22, as a vulnerable part for fastening the sunshade lamp 24, can only move up and down in the lower sunshade disc 21 and cannot be detached and replaced.

SUMMARY OF THE INVENTION

In view of the above, embodiments of the present invention provide a sunshade lamp fixing device and a sunshade, which are simple in structure, detachable and convenient in operation and use.

According to an embodiment of the present invention, a sunshade lamp fixing device comprises: a lower sunshade disc, a sunshade disc plug and a lamp fastener;

Wherein the lower sunshade disc is disposed below a sunshade canopy of the sunshade; the sunshade disc plug is fixed at a lower end of the lower sunshade disc; the lamp fastener is detachably mounted at a lower end of the sunshade disc plug, and the sunshade lamp is detachably fixed on the lamp fastener.

According to another embodiment of the present invention, there is provided a sunshade, comprising: a sunshade frame, an upper sunshade disc, a sunshade rib, a sunshade canopy, a lower sunshade disc, a support bar, a sunshade rod, a sunshade disc plug, a lamp fastener and a sunshade lamp;

Wherein the upper sunshade disc is fixed to a top end of the sunshade rod, the lower sunshade disc and the sunshade rod form a movement pair; an end of the sunshade rib is hinged to the upper sunshade disc, and the other end is suspended; an end of the support bar is hinged to the lower sunshade disc and the other end is hinged to the sunshade rib; the sunshade canopy covers the sunshade rib, and the sunshade rod is mounted on the sunshade frame.

Wherein the sunshade disc plug is fixed at a lower end of the lower sunshade disc; the lamp fastener is detachably mounted at a lower end of the sunshade disc plug, and the sunshade lamp is fixed on the lamp fastener.

According to the sunshade lamp fixing device and the sunshade according to an embodiment of the present invention, the sunshade disc plug is disposed between the lower sunshade disc and the lamp fastener, and the lamp fastener is detachably mounted below the sunshade disc plug. When the sunshade lamp is not needed, the sunshade lamp may be detached from the lamp fastener, and the lamp fastener is detached from the sunshade disc plug, whereupon the sunshade disc plug is directly exposed below the lower sunshade disc. As can be seen from the above, the sunshade lamp fixing device according to the embodiment of the present invention not only allows for pleasant appearance after the sunshade lamp is detached, but also meets the need for detachable lamp fastener, and it is simple in structure, detachable and convenient in operation and use.

DETAILED DESCRIPTION OF THE INVENTION

Technical solutions of in embodiments of the present invention will be described clearly and completely with reference to the figures in embodiments of the present invention. Obviously, the embodiments described below are only partial embodiments of the present invention, not all embodiments. All other embodiments obtained by those having ordinary skill in the art without making inventive efforts based on the embodiments in the present invention all fall within the protection scope of the present invention.

Figure 1:
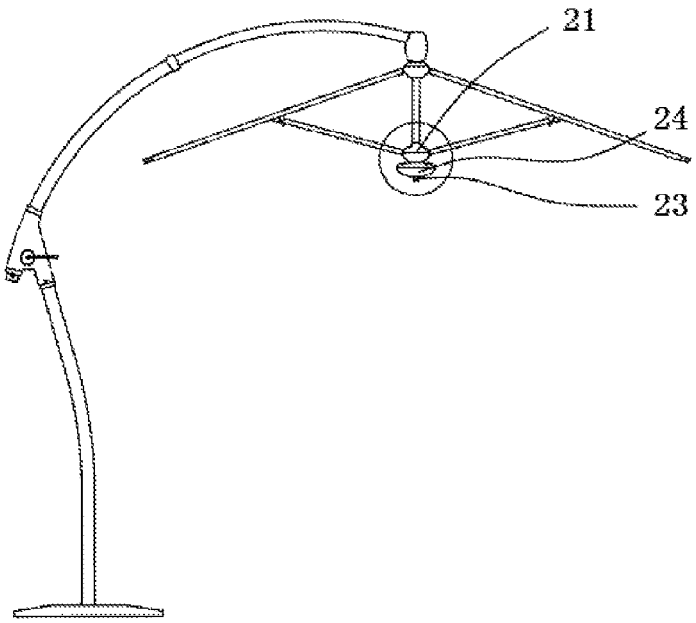
Fig. 1 (Prior Art)
FIG. 1 is a structural schematic view of a sunshade in the prior art.
Figure 2:
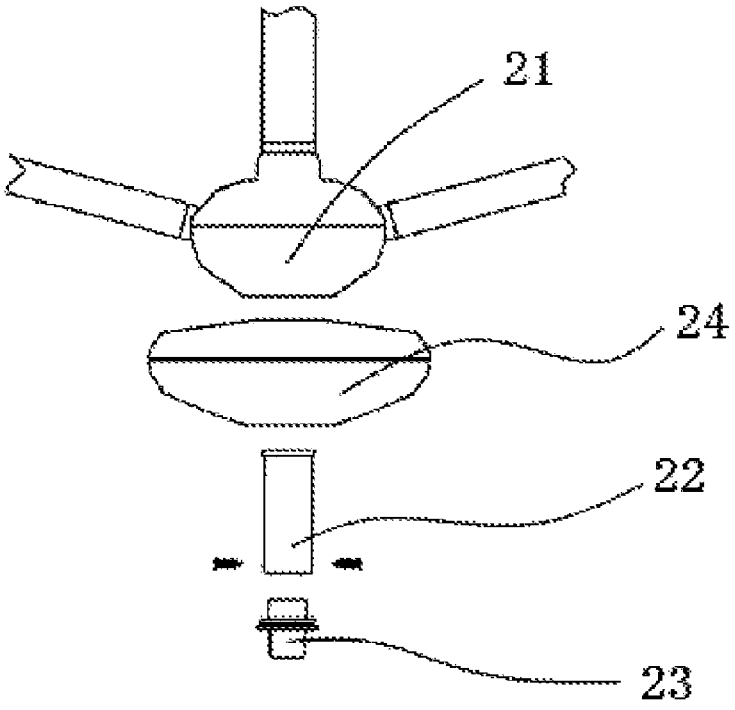
Fig. 2 (Prior Art)
FIG. 2 is an exploded schematic view after a sunshade lamp fixing device of the sunshade shown in FIG. 1 is partially enlarged.
Figure 3:
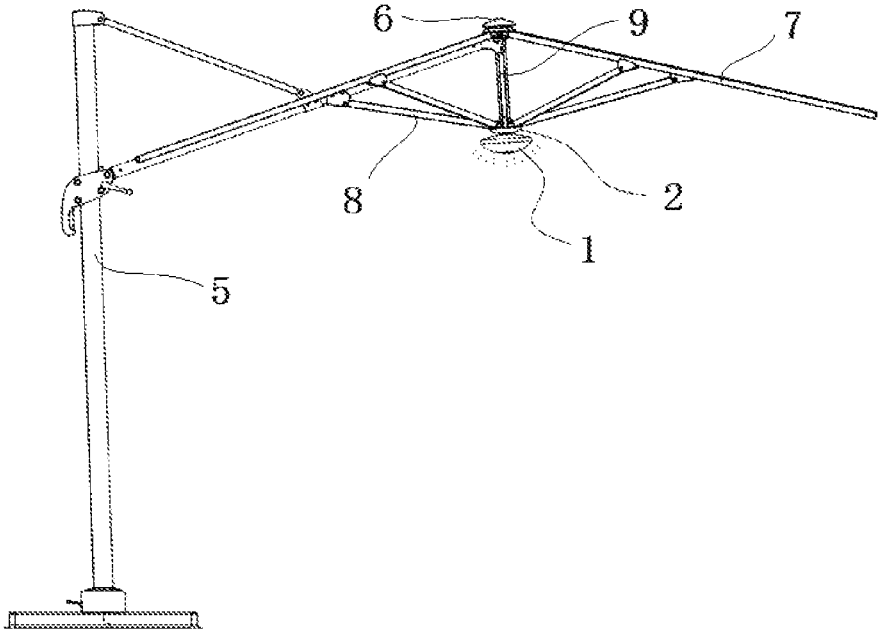
FIG. 3 is a structural schematic view with a sunshade lamp according to an embodiment of the present invention being mounted on the sunshade.
Figure 4:
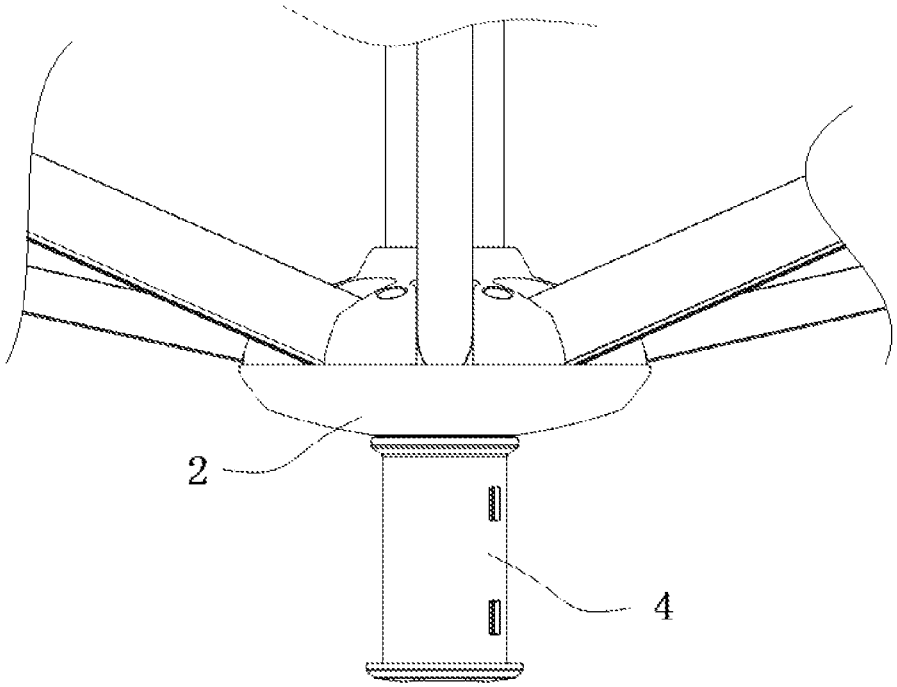
FIG. 4 is a structural schematic view of a sunshade lamp fixing device according to an embodiment of the present invention.
Figure 5:
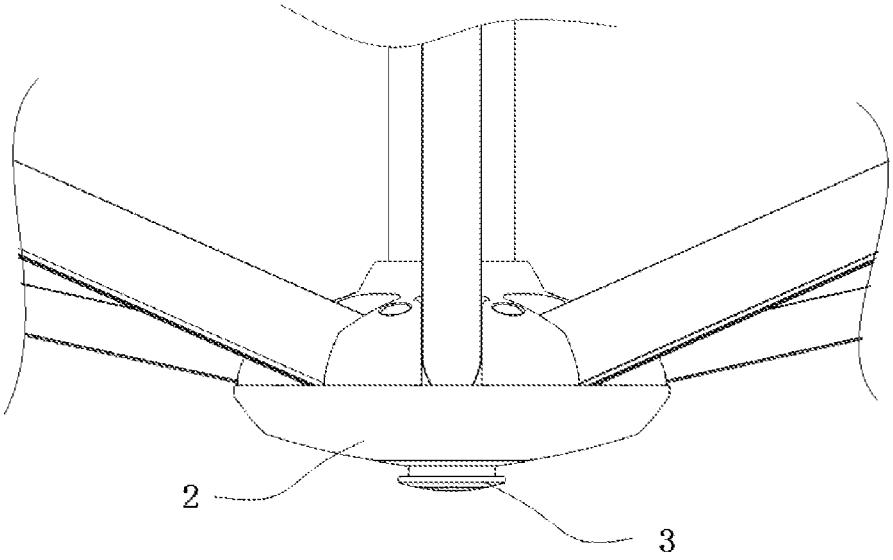
FIG. 5 is a structural schematic view after a lamp fastener of the sunshade lamp fixing device according to an embodiment of the present invention is detached.

As shown in FIG. 3 through FIG. 5, a sunshade lamp fixing device comprises: a lower sunshade disc 2, a sunshade disc plug 3 and a lamp fastener 4, wherein the lower sunshade disc 2 is disposed below a sunshade canopy of the sunshade; the sunshade disc plug 3 is fixed at a lower end of the lower sunshade disc 2; the lamp fastener 4 is detachably mounted at a lower end of the sunshade disc plug 3, and the sunshade lamp 1 is detachably fixed on the lamp fastener 4.

Those skilled in the art may appreciate that the sunshade disc plug 3 and the lower sunshade disc 2 are fixed in many manners, e.g., a top end of the sunshade disc plug 3 may be embedded into a bottom end of the lower sunshade disc 2 to achieve tight engagement, or the sunshade disc plug 3 may be locked with the lower sunshade disc 2 via a snap-fitting structure. The present invention does not limit manners for fixing the sunshade disc plug 3 with the lower sunshade disc 2.

In this way, when the sunshade lamp 1 is not needed, the sunshade lamp 1 may be detached from the lamp fastener 4, and the lamp fastener is detached from the sunshade disc plug 3, whereupon only the sunshade disc plug 3 is exposed at the lower end of the lower sunshade disc 2. As can be seen from the above, the sunshade lamp fixing device according to the embodiment of the present invention not only allows for pleasant appearance after the sunshade lamp 1 is detached, but also meets the need for detachable lamp fastener 4, and it is simple in structure, detachable and convenient in operation and use.

Those skilled in the art may appreciate that the sunshade lamp fixing device according to the embodiment of the present invention is adapted for a bent arm type sunshade as shown in FIG. 3. The bent arm type sunshade comprises: a sunshade frame 5, an upper sunshade disc 6, a sunshade rib 7, a sunshade canopy, a lower sunshade disc 2, a support bar 8, a sunshade rod 9, a sunshade disc plug 3, a lamp fastener 4 and a sunshade lamp 1. The upper sunshade disc 6 is fixed to a top end of the sunshade rod 9, the lower sunshade disc 4 and the sunshade rod 9 form a movement pair; an end of the sunshade rib 7 is hinged to the upper sunshade disc 6, and the other end is suspended; an end of the support bar 8 is hinged to the lower sunshade disc 4 and the other end is hinged to the sunshade rib 7; the sunshade canopy covers the sunshade rib 7, and the sunshade rod 9 is mounted on the sunshade frame 5.

When the sunshade is used, the lower sunshade disc 4 slides upward along the sunshade rod 9 to make the support bar 8 to expand outward to thereby enable the sunshade rib 7 to open and bring the sunshade canopy open. The sunshade disc plug 3 is fixed at a lower end of the lower sunshade disc 2; the lamp fastener 4 is detachably mounted at a lower end of the sunshade disc plug 3, and the sunshade lamp 1 is fixed on the lamp fastener 4.

In addition, the sunshade lamp fixing device according to the embodiment of the present invention is adapted for a straight rod type sunshade. At this time, the sunshade frame 5 employs a straight rod type structure, and a bottom end of the sunshade rod 9 is directly connected with the straight rod-shaped sunshade frame 5. The present invention does not limit the types of sunshades for which the sunshade lamp fixing device is adapted. No matter which kind of sunshade it is adapted for, the technical solution of the present invention can ensure that the sunshade lamp 1 is located below the lower sunshade disc 4 so that the lighting area is not blocked by any shielding object.

Several embodiments are used below to illustrate specific manners in which that the lamp fastener 4 is detachably mounted below the sunshade disc plug 3.

Figure 6:
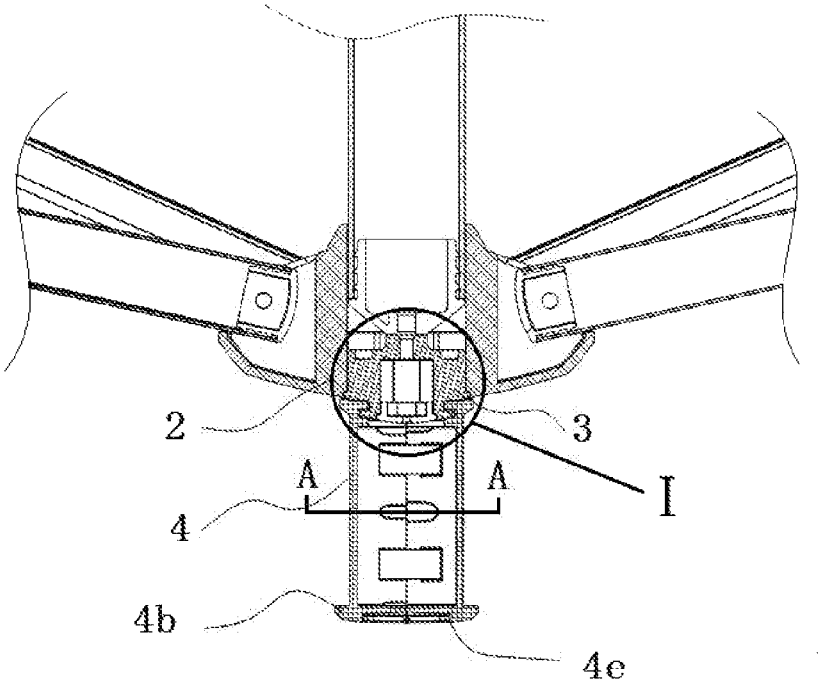
FIG. 6 is a sectional schematic view of the sunshade lamp fixing device according to an embodiment of the present invention.
Figure 7:
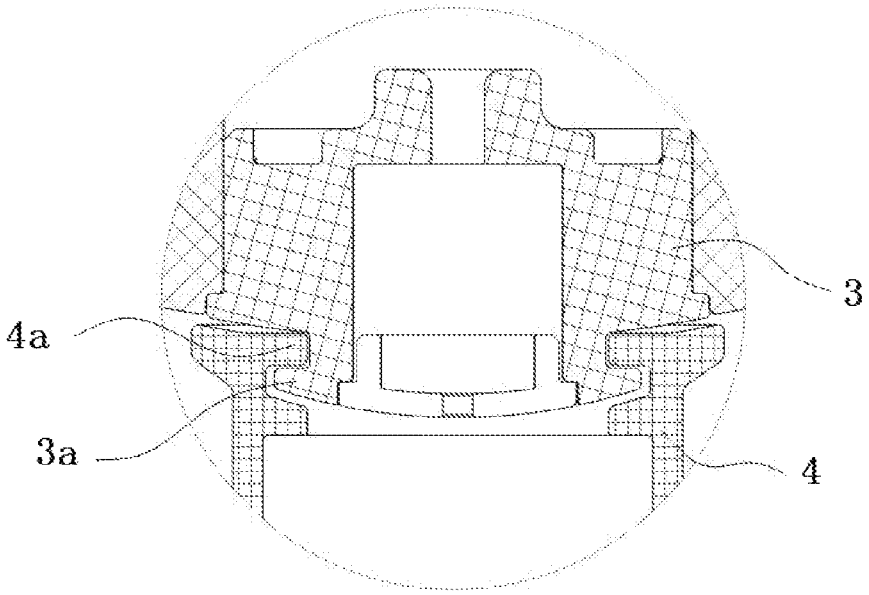
FIG. 7 is an enlarged view of a location I in FIG. 6.

FIG. 6 is a sectional schematic view of the sunshade lamp fixing device according to an embodiment of the present invention. FIG. 7 is an enlarged view of a location I in FIG. 6. As shown in FIG. 6 and FIG. 7, a lower portion of the sunshade disc plug 3 is provided with an annular snap slot 3*a*, and a convex ring 4*a* mating with the annular snap slot 3*a* is provided at a top end of the lamp fastener 4, wherein the lamp fastener 4 is formed by detachably joining at least two lamp fastener flaps 41, and said at least two lamp fastener flaps 41 are joined together to form the convex ring 4*a*.

In another embodiment of the present invention, the convex ring 4*a* may be provided in the lower portion of the sunshade disc plug 3, and the annular snap slot 3*a* mating with the convex ring 4*a* is provided at the top end of the lamp fastener 4. At this time, the lamp fastener 4 is formed by detachably joining at least two lamp fastener flaps 41, and said at least two lamp fastener flaps 41 are joined together to form the annular snap slot 3*a*.

In an embodiment of the present invention, to facilitate detachment of the lamp fastener flaps 41 when the sunshade lamp 1 needn't be used, said at least two lamp fastener flaps 41, after being joined together, form a detaching groove 4*e* on a bottom surface of the lamp fastener 4. As such, said at least two lamp fastener flaps 41 may be conveniently separated and detached by an operator with a hand pulling an inside wall of the detaching groove 4*e*.

A specific structure of the lamp fastener flaps 41 is illustrated by taking the lamp fastener 4 consisting of two lamp fastener flaps 41 as an example.

Figure 8:
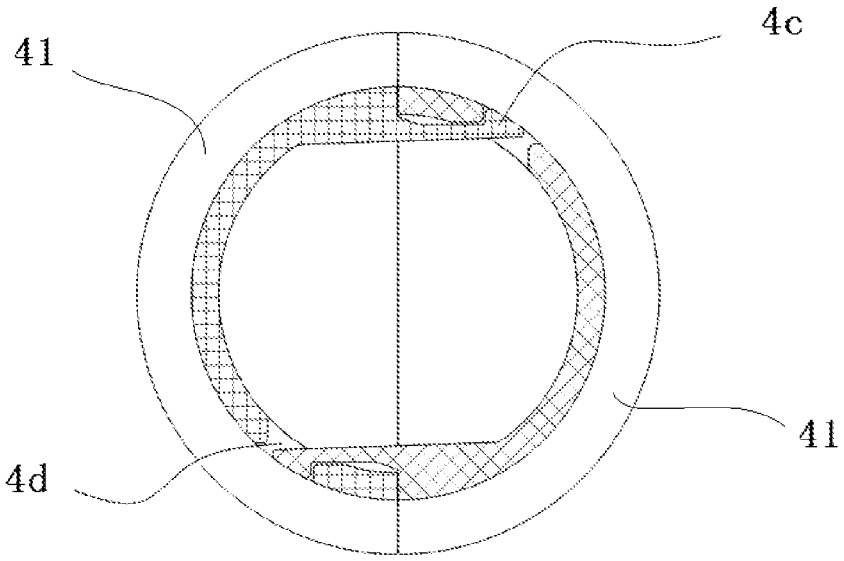
FIG. 8 is a sectional view taken along line A-A in FIG. 6.
Figure 9:
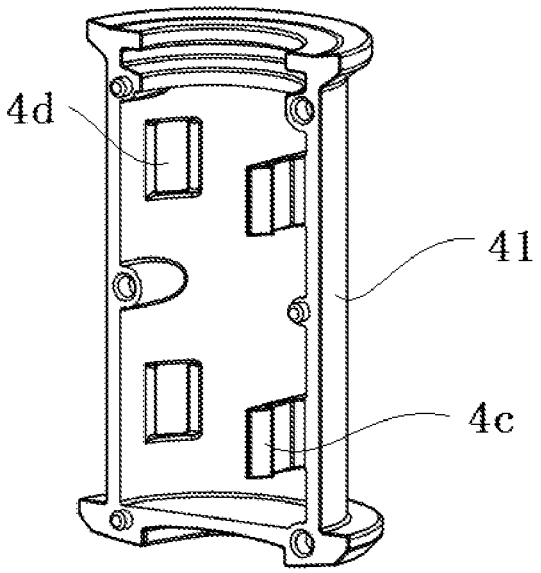
FIG. 9 is a structural schematic view of a lamp fastener flap in the sunshade lamp fixing device according to an embodiment of the present invention.

FIG. 8 is a sectional view taken along line A-A in FIG. 6. The lamp fastener 4 is formed by joining two lamp fastener flaps 41, and each lamp fastener flap 41 is shaped as shown in FIG. 9. Each lamp fastener flap 41 is provided with a snap hook 4*c* and a snap opening 4*d* snap-fitting with the snap hook 4*c*. The two lamp fastener flaps 41 are joined together via the snap hook 4*c* and the snap opening 4*d* to form the lamp fastener 4.

Figure 10:
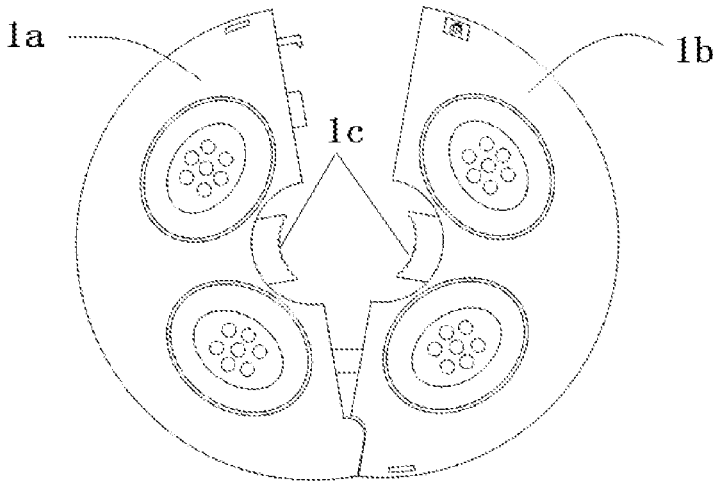
FIG. 10 is a structural schematic view of a sunshade lamp according to an embodiment of the present invention.

FIG. 10 is a structural schematic view of a sunshade lamp according to an embodiment of the present invention. As shown in FIG. 10, the sunshade lamp is applicable to the cylindrical lamp fastener 4 of the sunshade lamp fixing device shown in FIG. 3 through FIG. 9. Specifically, a center of the sunshade lamp 1 is provided with a fastening hole matching with the cylindrical lamp fastener 4, elastic components 1*c* are provided on a circumferential direction of the inside of the fastening hole, and the sunshade lamp 1 is fastened on the lamp fastener 4 via the elastic components 1*c*.

As shown in FIG. 10, the sunshade lamp 1 is formed by detachably joining a first sunshade lamp flap 1*a* and a second sunshade lamp flap 1*b*. The first sunshade lamp flap 1*a* and the second sunshade lamp flap 1*b* are hinged to each other at one end and are detachably connected by a snap-fitting structure at the other end. As such, when the first sunshade lamp flap 1*a* is joined to the second sunshade lamp flap 1*b* by snap-fitting, the fastening hole is formed at a central portion. However, those skilled in the art may appreciate that the sunshade lamp 1 may also be formed by joining more than two sunshade lamp flaps so long as the fastening hole is formed after these sunshade lamp flaps are joined together.

In an embodiment of the present invention as shown in FIG. 6, to prevent disengagement of the sunshade lamp 1 from the cylindrical lamp fastener 4, an annular boss 4*b* may be provided at a bottom end of the lamp fastener 4. As such, when the sunshade lamp 1 is fastened on the lamp fastener 4, the annular boss 4*b* may prevent longitudinal disengagement of the sunshade lamp 1.

Those skilled in the art may further appreciate that when the lamp fastener 4 is in other shapes, the sunshade lamp 1 may also employ other structures matching the lamp fastener 4 so long as the sunshade lamp 1 can be fastened on the lamp fastener 4. The present invention does not limit the detachable fixing manners of the sunshade lamp 1 and the lamp fastener 4.

As appreciated, although determiners such as "up" and "down" are used in the depictions of the above embodiments, these determiners are only used to more clearly describe specific embodiments with reference to the figures, not used to limit the protection scope of the present invention. In addition, although the present invention uses the following universal terms in the field: sunshade lamp, sunshade lamp flap, elastic component, lower sunshade disc, sunshade frame, upper sunshade disc, sunshade rib, sunshade canopy, lower sunshade disc, support bar, sunshade rod, sunshade disc plug, annular groove, lamp fastener, lamp fastener flap, convex ring, annular boss, snap hook, snap opening and detaching groove, a possibility of using other terms is not excluded. Use of these terms is only intended to more conveniently describe and interpret the essence of the present invention; interpreting them as any additional limitation contravenes with the specific of the present invention.

What are described above are only preferred embodiments of the present invention, and are not intended to limit the present invention. Any modifications and equivalent substitutions made within the spirit and principle of the present invention shall all be included in the protection scope of the present invention.

The invention claimed is:

1. A sunshade lamp fixing device, comprising: a lower sunshade disc, a sunshade disc plug and a lamp fastener; the lower sunshade disc disposed below a sunshade canopy of a sunshade; the sunshade disc plug fixed at a lower end of the lower sunshade disc; the lamp fastener detachably mounted at a lower end of the sunshade disc plug; the sunshade lamp detachably fixed to the lamp fastener; and further comprising one of:

(a) a lower portion of the sunshade disc plug comprising an annular snap slot; the lamp fastener comprising a convex ring at atop end of said lamp fastener for mating with the annular snap slot of the sunshade disc plug; and wherein the lamp fastener further comprising at least two lamp fastener flaps detachably joinable to each other, wherein the joining together of the at least two lamp fastener flaps define the convex ring; or (b) the sunshade disc plug comprising a convex ring at a lower end of the sunshade disc plug; the top end of the lamp fastener comprising an annular snap slot for mating with the convex ring of the sunshade disc plug, wherein; and the lamp fastener further comprising at least two lamp fastener flaps detachably joinable to each other, wherein the joining together of the at least two lamp fastener flaps define the annular snap slot.

2. The sunshade lamp fixing device according to claim 1, wherein each of the lamp fastener flaps is provided with a snap hook and a snap opening snap-fitting with the snap hook, wherein the at least two lamp fastener flaps are joined together via the snap hook and the snap opening to form the lamp fastener.

3. The sunshade lamp fixing device according to claim 1, wherein at least two lamp fastener flaps, after being joined together, form a detaching groove on a bottom surface of the lamp fastener.

4. The sunshade lamp fixing device according to claim 1, wherein the lamp fastener is cylindrical, a center of the sunshade lamp is provided with a fastening hole matching with the cylindrical lamp fastener, elastic components are provided on a circumferential direction of the inside of the fastening hole, and the sunshade lamp is fastened on the lamp fastener via the elastic components.

5. The sunshade lamp fixing device according to claim 4, wherein the sunshade lamp is formed by detachably joining at least two sunshade lamp flaps, and the at least two sunshade lamp flaps, after being joined together, form the fastening hole.

6. The sunshade lamp fixing device according to claim 5, wherein the sunshade lamp is formed by detachably joining a first sunshade lamp flap and a second sunshade lamp flap, wherein the first sunshade lamp flap and the second sunshade lamp flap are hinged to each other at one end and are detachably connected by a snap-fitting structure at the other end.

7. The sunshade lamp fixing device according to claim 4, wherein an annular boss is provided at a bottom end of the lamp fastener to prevent disengagement of the sunshade lamp from the lamp fastener.

8. A sunshade, comprising: a sunshade frame, an upper sunshade disc, a sunshade rib, a sunshade canopy, a lower sunshade disc, a support bar, a sunshade rod, a sunshade disc plug, a lamp fastener and a sunshade lamp; the upper sunshade disc fixed to a top end of the sunshade rod; the lower sunshade disc and the sunshade rod defining a movement pair; one end of the sunshade rib hinged to the upper sunshade disc, and the other end is suspended; one end of the support bar hinged to the lower sunshade disc and the other end of the support bar hinged to the sunshade rib; the sunshade canopy covers the sunshade rib, and the sunshade rod is mounted on the sunshade frame; the sunshade disc plug fixed at a lower end of the lower sunshade disc; the lamp fastener detachably mounted at a lower end of the sunshade disc plug; the sunshade lamp fixed to the lamp fastener; and further comprising one of:

(a) a lower portion of the sunshade disc plug comprising an annular snap slot; the lamp fastener comprising a convex ring at atop end of said lamp fastener for mating with the annular snap slot of the sunshade disc plug; and wherein the lamp fastener further comprising at least two lamp fastener flaps detachably joinable to each other, wherein the joining together of the at least two lamp fastener flaps define the convex ring; or (b) the sunshade disc plug comprising a convex ring at a lower end of the sunshade disc plug; the top end of the lamp fastener comprising an annular snap slot for mating with the convex ring of the sunshade disc plug, wherein; and the lamp fastener further comprising at least two lamp fastener flaps detachably joinable to each other, wherein the joining together of the at least two lamp fastener flaps define the annular snap slot.

* * * * *